US010568439B2

(12) United States Patent
Bersamin

(10) Patent No.: US 10,568,439 B2
(45) Date of Patent: Feb. 25, 2020

(54) SEMI-AUTOMATIC ASSEMBLY DISPLAY HUTCH

(71) Applicant: Sonoco Development, Inc., Hartsville, SC (US)

(72) Inventor: Glen Bersamin, New Lenox, IL (US)

(73) Assignee: Sonoco Development, Inc., Hartsville, SC (US)

( * ) Notice: Subject to any disclaimer, the term of this patent is extended or adjusted under 35 U.S.C. 154(b) by 0 days.

(21) Appl. No.: 15/982,007

(22) Filed: May 17, 2018

(65) Prior Publication Data

US 2019/0350383 A1 Nov. 21, 2019

(51) Int. Cl.
*A47F 3/00* (2006.01)
*A47B 43/00* (2006.01)

(52) U.S. Cl.
CPC ..... *A47F 3/004* (2013.01); *A47B 43/00* (2013.01)

(58) Field of Classification Search
CPC .. A47F 3/004; A47F 5/11; A47F 5/112; A47F 5/116; A47F 5/0018; A47F 5/10; A47B 47/06; A47B 43/00; A47B 43/02
USPC ..... 211/147
See application file for complete search history.

(56) References Cited

U.S. PATENT DOCUMENTS 1,602,410 A 10/1926 Hamblin
2,150,743 A 3/1939 Mancuso
2,340,148 A 1/1944 Silberstein
3,863,575 A 2/1975 Kuns et al.
4,151,803 A 5/1979 Ferrera et al.
4,630,740 A 12/1986 Belokin, Jr.
5,273,169 A 12/1993 Maglione
5,366,100 A 11/1994 Maglione
5,826,732 A 10/1998 Ragsdale
6,752,280 B2 6/2004 Dye
7,007,615 B2 3/2006 Grueneberg
7,252,200 B1 8/2007 Hester
7,374,047 B2 5/2008 Bryson et al.
7,677,433 B2 3/2010 Little
7,703,864 B2 4/2010 Moser
7,905,365 B2 3/2011 Virvo
8,485,370 B2 7/2013 Dewhurst
8,857,633 B2 10/2014 Dewhurst
9,211,021 B2 12/2015 Smith
9,474,389 B2 10/2016 Pfeifer et al.
9,743,783 B1 8/2017 Bersamin
9,844,282 B2 12/2017 Smith
9,907,414 B2 3/2018 Heuer
2004/0148825 A1* 8/2004 Myers ..... A47F 5/116 40/124
2008/0169339 A1* 7/2008 Moser ..... B65D 5/5213 229/108.1
2010/0006529 A1* 1/2010 Groff ..... A47F 5/116 211/186
2011/0049072 A1* 3/2011 Dewhurst ..... A47F 5/116 211/135
2013/0213915 A1 8/2013 Pfeifer et al.
2017/0079449 A1 3/2017 Smith

* cited by examiner

*Primary Examiner* — Patrick D Hawn
(74) *Attorney, Agent, or Firm* — Miller, Matthias & Hull LLP

(57) ABSTRACT

A display hutch that may be shipped flat, then semi-automatically constructed by pushing downward and rearward on a rear shelf panel, then pushing downward and rearward on each of a plurality of front shelf panels.

12 Claims, 13 Drawing Sheets

SEMI-AUTOMATIC ASSEMBLY DISPLAY HUTCH

BACKGROUND OF THE INVENTION

Field of the Invention

This invention patent relates to a display hutch. More particularly, this invention relates to a display hutch made from two blanks and may be shipped flat, then "semi-automatically" constructed by squaring up the hutch body, pushing downward and rearward on a single rear shelf panel or rear support, then rotating each front shelf panel and attaching it to a corresponding rear shelf panel.

Description of the Related Art

Display hutches can be used to display items in a retail setting. Typically display hutches are made of multiple components and sometimes even require fasteners. Display hutches can also require complex assembly steps, and can be large even when knocked down. The present disclosure is designed to solve these problems.

BRIEF SUMMARY OF THE INVENTION

The present disclosure relates to a display hutch that may be shipped flat, then semi-automatically constructed by pushing downward and rearward on a rear shelf panel, then pushing downward and rearward on each of a plurality of front shelf panels.

In one aspect the display hutch comprises a rear wall, two side walls, a plurality of front panels, a plurality of shelves and a rear support. The rear wall extends vertically from a base to a top edge and horizontally from one rear vertical edge to another rear vertical edge. Each of the side walls extends forward from one of the rear vertical edges to a front vertical edge. Each front panel extends laterally between the two side walls and is hingedly attached to each side wall along the front vertical edges. The front panels define a front façade. The rear wall, the side walls and the front panels define a hutch body having an interior in which the rear support is disposed. Each shelf comprises a front shelf panel and a rear shelf panel. Each front shelf panel is affixed to the rear shelf panel to form a load bearing surface. The hutch may comprises a plurality of inner lip panels, each of which may be attached to a front panel along a fold line. The hutch may further comprises a rear attachment panel hingedly connected to each rear shelf panel along a rear fold line. Each rear attachment panel is attached to the rear support by, for example glue. The rear support is interposed between the rear attachment panels and the rear wall.

The rear shelf panels are operably connected to each other so that they are moveable in unison from a first position in which the rear shelf panels are vertically oriented to a second position in which the rear shelf panels are horizontally oriented.

The rear wall, the side walls, the front panels, the front shelf panels, the rear shelf panels and the rear attachment panels may be formed from a first blank. The rear support is formed from a second blank.

The hutch may further comprise a plurality of intermediate horizontal panels, each hingedly attached to a rear shelf panel along an intermediate fold line, and an half panel foldably connected to the rear wall and extending forward from the rear wall to a line between the rear wall and the front façade. The half panel is attached to the intermediate horizontal panels along the a series of co-linear intermediate fold lines.

The hutch may further comprise a tab attached to each front shelf panel, wherein each rear shelf panel defines a slot configured to receive a tab.

The hutch may further comprise a glue panel foldably connected to the intermediate horizontal panels along intermediate vertical fold lines and adhered to a side panel.

Each front shelf panel may be separately (individually) movable between a vertical orientation and a horizontal orientation.

In another aspect the disclosure relates to a method of constructing a hutch comprising the steps of: providing an assembled (folded and glued) display hutch comprising a rear wall having two rear vertical edges, a side wall foldably attached to each rear vertical edge and having a front vertical edge, a plurality of front panels, each front panel hingedly attached to both side walls, a plurality of shelves, each shelf comprising a front shelf panel affixed to a rear shelf panel to form a load bearing surface, each front shelf panel hingedly attached to a front panel, each rear shelf panel hingedly attached to an intermediate horizontal panel along an intermediate fold line, a rear attachment panel hingedly connected to each rear shelf panel, and a rear support attached to each rear attachment panel; rotating the rear shelf panels in unison by rotating one of the rear shelf panels around an intermediate fold line until all of the rear shelf panels are in a horizontal orientation and the rear support abuts the rear wall; and individually moving each front shelf panel rearward and downward until each front shelf panel is in a horizontal orientation.

DETAILED DESCRIPTION OF THE INVENTION

Figure 1:
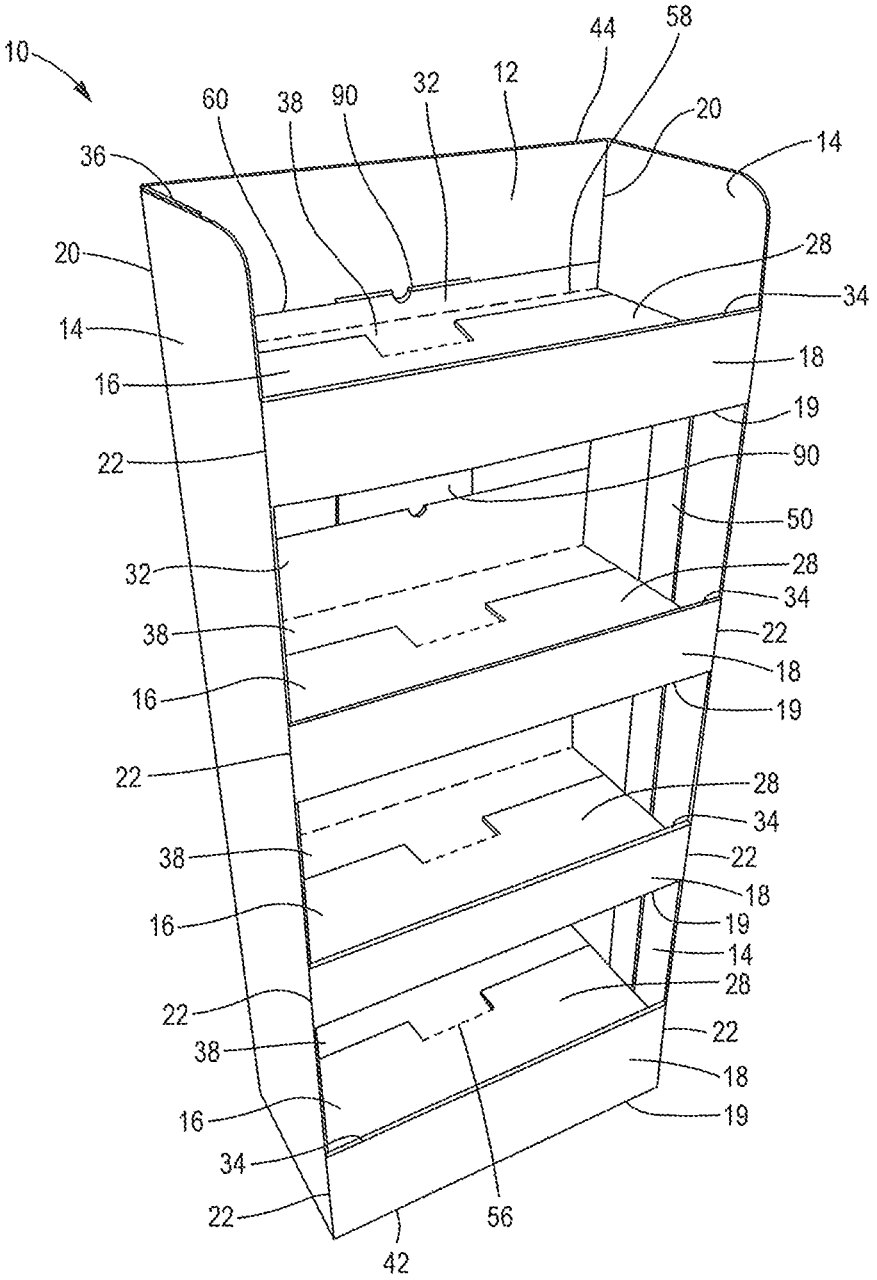
FIG. 1 is a front perspective view of a fully assembled hutch according to the disclosure.

While the invention described herein may be embodied in many forms, there is shown in the drawings and will herein be described in detail one or more embodiments with the understanding that this disclosure is to be considered an exemplification of the principles of the invention and is not intended to limit the disclosure to the illustrated embodiments. Aspects of the different embodiments can be combined with or substituted for one another.

As will be appreciated, terms such as "horizontal" and "vertical", "front" and "rear", "top" and "bottom," (etc.), used as nouns, adjectives or adverbs refer in this description to the orientation of the structure of the hutch as it is illustrated in FIG. 1. For example, front panels 18 in FIG. 1 are said to extend "laterally" or "horizontally". Such terms are not intended to limit the invention to a particular orientation.

The disclosure relates to a display hutch that may be assembled for folding and gluing two blanks, shipped flat, then "semi-automatically" constructed by squaring up a body, pushing downward and rearward on a rear shelf panel and/or a rear support, and pushing downward and rearward on each of a plurality of individual front shelf panels.

The Display Hutch

Turning to the drawings, FIG. 1 is a front perspective view of a display hutch 10 according to the disclosure. The hutch 10 is made from two separate blanks, a first blank 40 and a second blank 90 (also referred to as a rear support) adhered together to form the assembled hutch 10, then constructed (erected) into the three dimensional configuration shown in FIG. 1. The hutch 10 is foldable so it can be shipped flat, then constructed on site to hold and display articles in a retail setting.

The hutch 10 comprises a rear wall 12, two opposing side walls 14, shelves 16, front panels 18, an half panel 36 and a glue panel 50. The hutch 10 has two rear corners 20 (a.k.a. rear vertical edges) and two front corners 22 (a.k.a. front vertical edges).

The rear wall 12 may extend vertically the full height of the hutch 10 from a base or bottom edge 42 to a top or top edge 44 and horizontally from one side wall 14 to the opposite side wall 14.

Each side wall 14 extends forward from a rear vertical edge 20 to a front vertical edge 22. Each side wall 14 is hingedly attached to the rear wall 12 along one of the rear vertical edges 20 and also to a plurality of front panels 18 along one of the front vertical edges 22, the rear and front vertical edges 20, 22 functioning as fold lines.

Each shelf 16 is formed from two components: a front shelf panel 28 and a rear shelf panel 38, both of which are parts of the first blank 40. Each shelf 16 extends laterally between one side wall 14 and the opposing side wall 14 and has free (unattached) side edges 15 as perhaps best shown in FIG. 2. Each shelf 16 is foldably connected to a corresponding inner lip panel 30 along a shelf front fold line 31. Each shelf 16, or rather the rear shelf panel 38 of each shelf 16, is attached to the rear support 90 by a series of rear attachment panels 32 as described in more detail below. Thus, each shelf 16 is supported in front by an inner lip panel 30 and in back by the rear support 90.

Each front panel 18 may extend above the load bearing surface of the corresponding shelf 16 to form a lip to help keep the products on the shelves 16 and prevent the products from accidentally falling onto the floor. Each front panel 18 extends downward from a single or lip fold line 34 to a free bottom edge 19. Each front panel 18 extends horizontally between and is foldably attached to the side walls 14 along the front vertical edges 22. The front panels 18 make up most or all of the front façade of the hutch 10 and may bear graphics for marketing or aesthetic purposes.

An inner lip panel 30 is foldably attached to each front panel 18 along the single or lip fold line 34 and extends downward to a shelf front fold line 31. Thus each lip comprises two panels: the inner lip panel 30 and a top portion of the front panel 18. (The inner lip panels 30 and the shelf front folds lines 31 are not visible in FIG. 1 because they are obscured by the front panels 18.)

Each front shelf panel 28 forms the front portion of each shelf 16. Each front shelf panel 28 is foldably connected to an inner lip panel 30 along a shelf front fold line 31 and extends rearward therefrom to a free edge 54 located somewhere between the real wall 12 and the front panels 18. Each front shelf panel 28 may include a tab 29 near the rear free edge 54, the purpose of which is explained below. The tab 29 may be hingedly attached to the front shelf panel 28 along a tab fold line 27.

The half panel 36, barely visible in FIG. 1 above the left side wall 14, is foldably connected to the rear wall 12 along a rear vertical edge 20 and to a plurality of intermediate horizontal panels 46 along a series of co-linear intermediate vertical fold lines 48.

Each intermediate horizontal panel 46 extends horizontally from an intermediate vertical fold line 48 to the glue panel 50, and is connected to the glue panel 50 along a glue panel fold line 49.

Each rear shelf panel 38 forms the rear portion of each shelf 16 and extends rearward from an intermediate horizontal panel 46 to the rear support 90. Each rear shelf panel 38 is hingedly connected to an intermediate horizontal panel 46 along a rear shelf panel fold line 56. Each rear shelf panel 38 may define a slot 57 located in the middle of and co-linear with or adjacent to the rear shelf panel fold line 56. The rear shelf panels 38 are operably connected to each other by the rear support 90 so that moving one rear shelf panel 38 simultaneously moves every rear shelf panel 38.

A rear attachment panel 32 is foldably connected to and extends upward from the rear edge of each rear shelf panel 38 along a rear attachment panel fold line 58 and terminates at a rear free edge 60. Each rear free edge 60 may define a locating notch 62 which may be used to help assemble the hutch 10 as explained below.

As noted above, the glue panel 50 is foldably connected to the intermediate horizontal panels 46 along intermediate vertical fold lines 48. In the constructed hutch 10 the glue panel is glued or otherwise adhered to a side wall 14 at a location between the rear wall 12 and the front façade.

The rear support 90 may be substantially rectangular in shape and starts out as a separate piece which is then glued or otherwise attached the rear attachment panels 32 to help form the assembled hutch 10. The rear support 90 extends upward from the floor to about the top/rear edge 54 of the topmost attachment panel 32.

Figure 8:
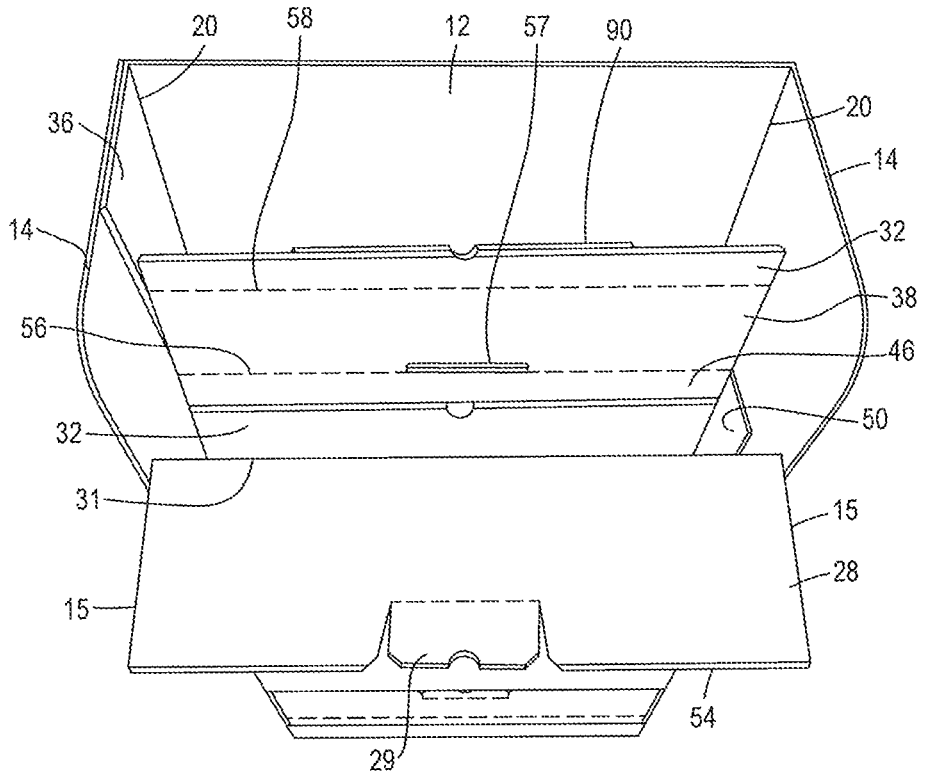
FIG. 8 is a top perspective view of the hutch of FIG. 7 after it has been stood on its base.
Figure 9:
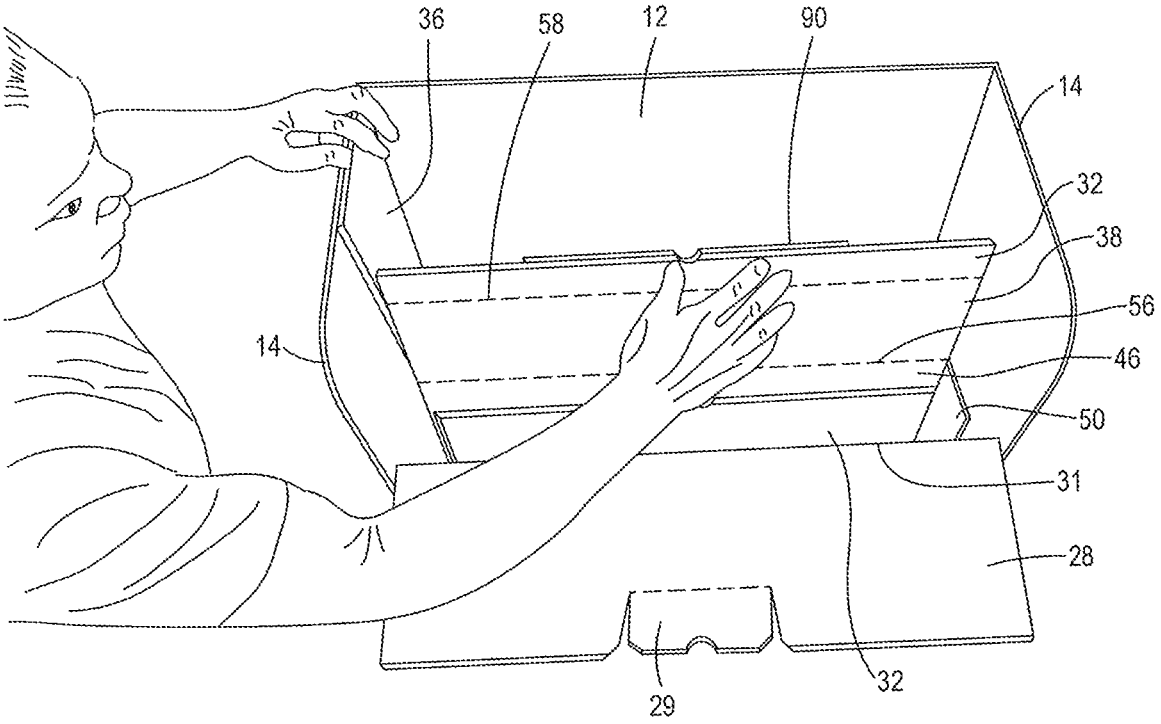
FIG. 9 is a top perspective view of the hutch of FIG. 8 just before the rear shelf panels are rotated into a second (horizontal) position.
Figure 10:
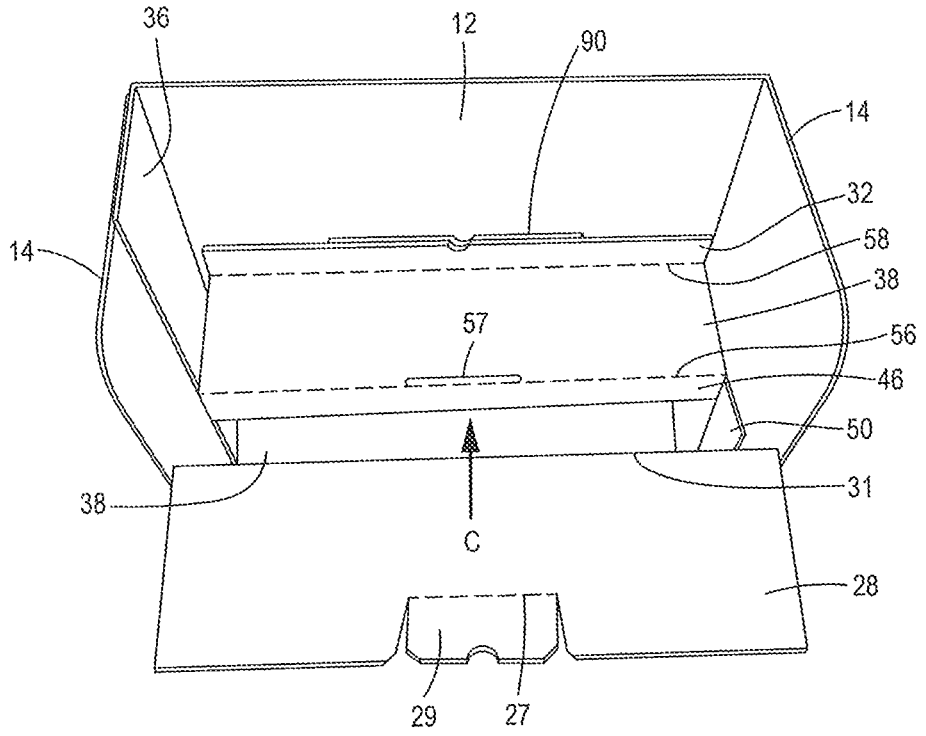
FIG. 10 is a top perspective view of the hutch of FIG. 9 after the rear shelf panels have been rotated into a second (horizontal) position.

As explained in more detail below, moving the rear support 90 up and down (as shown in FIGS. 8-10) causes the rear shelf panels 38 to move in unison between a first position in which the rear shelf panels 38 are in a vertical orientation and a second position in which the rear shelf panels 38 are in a horizontal orientation and orthogonal to the rear wall 12. After the rear shelf panels 38 have been moved into a horizontal orientation each of the front shelf panels 28 can then be moved individually from a vertical orientation to a horizontal orientation and attached to a corresponding rear shelf panel 38, in what may be referred to as a "semi-automatic" assembly process.

The First Blank 40

Figure 2:
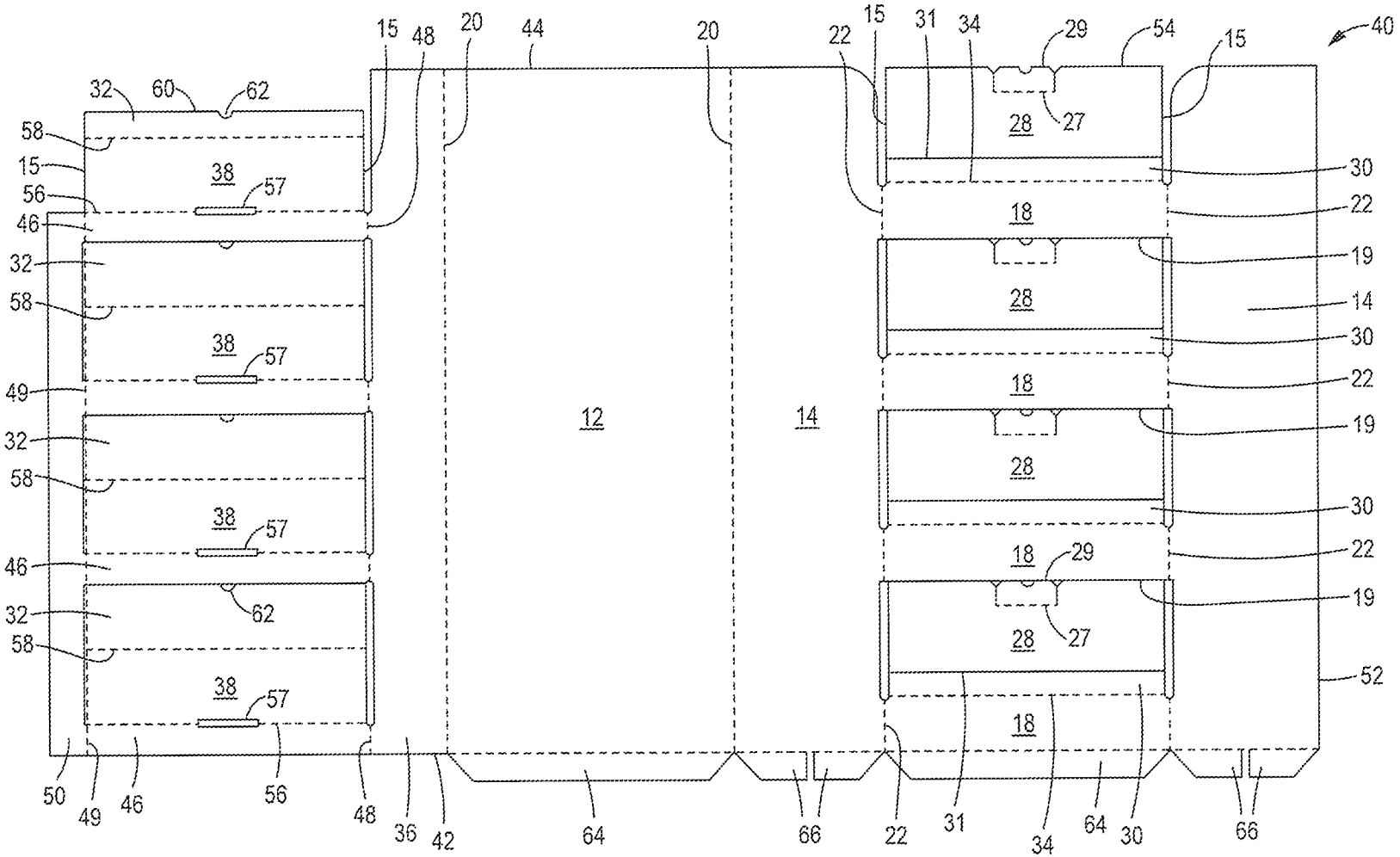
FIG. 2 is a top plan view of a first blank used to make the hutch of FIG. 1.

FIG. 2 is a top plan view of the first blank 40 used to make the hutch 10 of FIG. 1. The first blank 40 is used to make everything except the rear support 90, including the rear wall 12, the opposing side walls 14, the shelves 16, the front panels 18, the half panel 36 and the glue panel 50.

The rear wall 12 may be substantially rectangular and may extend vertically from a bottom edge 42 to a top edge 44 and horizontally from one rear vertical edge 20 to an opposing rear vertical edge 20. Each rear vertical edge 20 may be a fold line, score line or any suitable linear demarcation between panels.

The rear wall 12 is foldably connected to a side wall 14 along one rear vertical edge 20 and to the half panel 36 along the other rear vertical edge 20.

One side wall 14, in this case, the right side wall 14, is foldably connected to the rear wall 12 along a rear vertical edge 20 and to the front panels 18 along a front vertical edge 22 or, perhaps more descriptively, a series of front vertical edges 22.

The other side wall 14, the left side wall 14, is foldably connected to the front panels 18 along the other front vertical edge 22. The left side wall 14 of FIG. 2 extends from the left front vertical edge 22 to a free edge 52. The side walls 14 may have the same width and the same height. The width of the side walls 14 determines the depth of the hutch 10. Thus, the hutch 10 may be made deeper by making the side walls 14 wider.

Each front panel 18 is foldably connected along one lateral end to a side wall 14 and at the opposite end to the other side wall 14. Each front panel 18 is connected to an inner lip panel 30 along a single or double lip fold line 34 and has a free bottom edge 19.

Each front shelf panel 28 is foldably connected to an inner lip panel 30 along a shelf front fold line 31. Each front shelf panel 28 may include a tab 29 near the rear free edge 54. The tab 29 is hingedly attached to the rear shelf panel 38 along a tab fold line 27. Each front shelf panel 28 may have a width approximately equal to or slightly less than the width of the rear wall 12, and may extend laterally from one free edge 15 to an opposite free edge 15.

The half panel 36 is foldably connected to the rear wall 12 along a rear vertical edge 20 and to intermediate horizontal panels 46 along an intermediate vertical fold line 48. The intermediate horizontal panels 46 are connected to a glue panel 50 along a glue panel fold line 49.

Each rear shelf panel 38 is foldably connected to an intermediate horizontal panel 46 along a rear shelf panel fold line 56. Each rear shelf panel 38 may define a slot 57 located between the free side edges 15 of the rear shelf panel 38 and co-linear with or adjacent to the rear shelf panel fold line 56.

A rear attachment panel 32 is foldably connected to each rear shelf panel along a rear attachment panel fold line 58. Each rear attachment panel 32 extends from the rear attachment panel fold line 58 to a rear free edge 60. Each free rear edge 60 may define a locating notch 62 which may help assemble the hutch 10 as explained below.

Front and rear bottom panels 64 and side wall bottom panels 66 may be foldably attached to each of the major panels (rear wall 12 and side walls 14) and the lowest front panel 18 along the bottom edge 42 of the first blank 40. The side wall bottom panels 66 may be configured to interlock with the other bottom panels 64.

The glue panel 50 is foldably connected to the intermediate horizontal panels 46 along intermediate vertical fold lines 48.

The Rear Support 90

Figure 3:
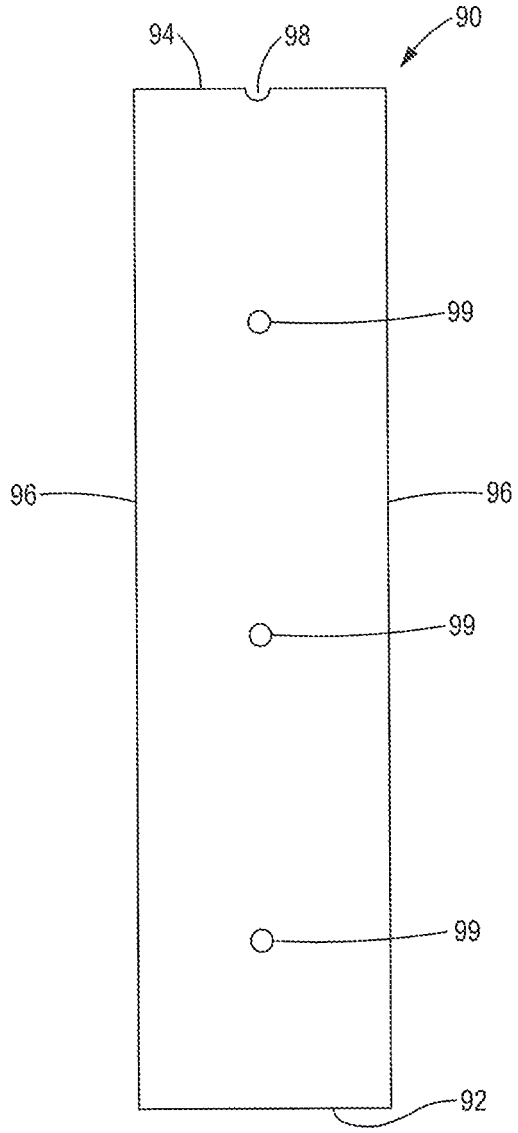
FIG. 3 is a top plan view of a second blank used to make the hutch of FIG. 1.

FIG. 3 is a top plan view of the second blank 90 used as a rear support. The second blank 90 engages and supports the rear of the shelves 16. The second blank 90 may be substantially rectangular and extends from a bottom edge 92 to a top edge 94 and from one side edge 96 to an opposite side edge 96. The top edge 94 may define a locating notch 98. The second blank 90 may define locating holes 99 located equidistant the side edges 96 and spaced apart in the vertical dimension. The width of the second blank 90 may be less than the width of the shelves 16, but wide enough to help support the shelves 16. The height of the second blank 90 preferably is such that, when the rear shelf panels 38 are folded down and assume a horizontal configuration, the bottom edge 92 of the rear support 90 contacts the floor or surface on which the hutch 10 stands.

Assembling (Folding and Gluing) the Hutch 10

Figure 4:
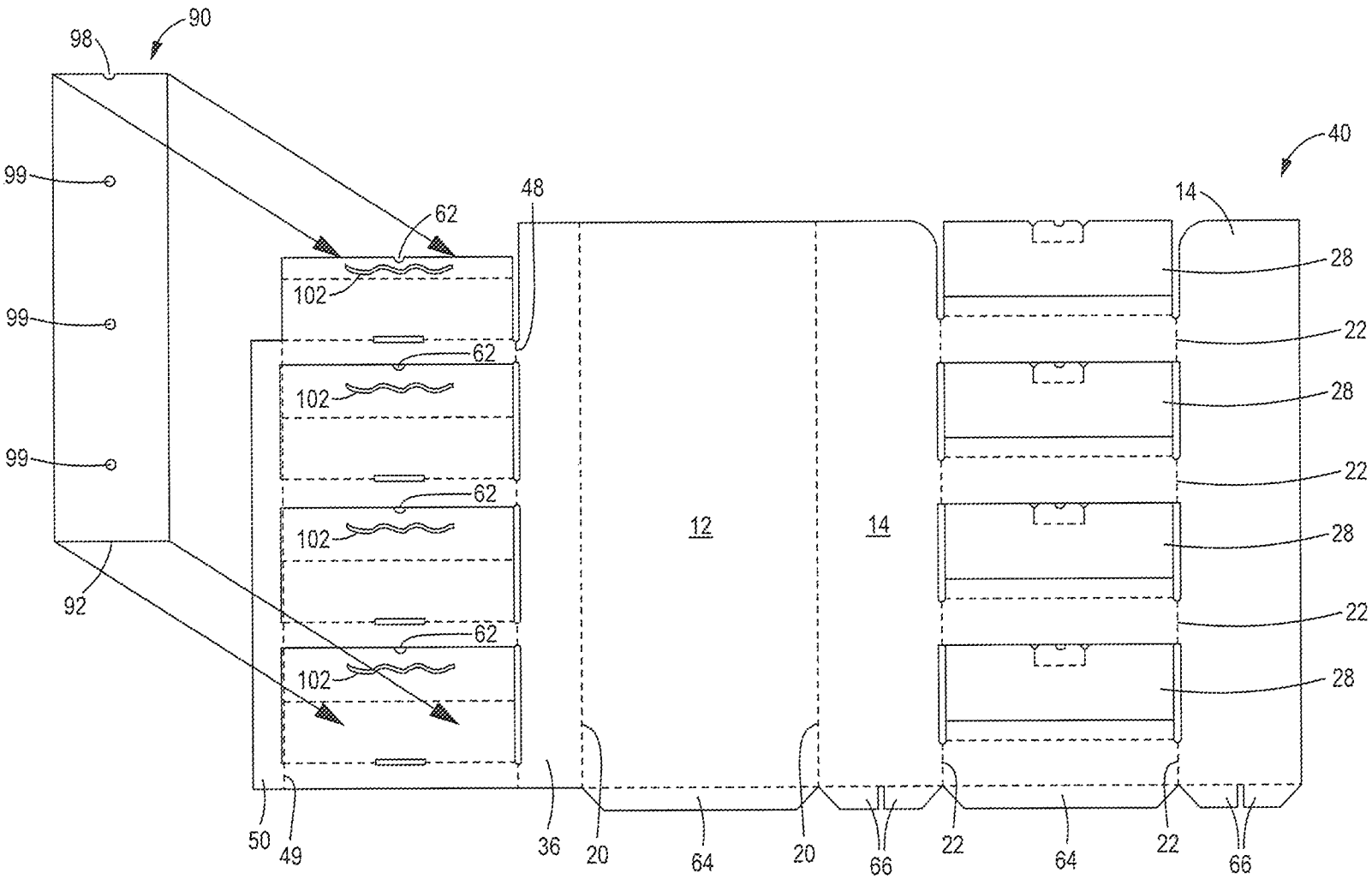
FIG. 4 is a perspective view of the second blank being adhered to the first blank.
Figure 5:
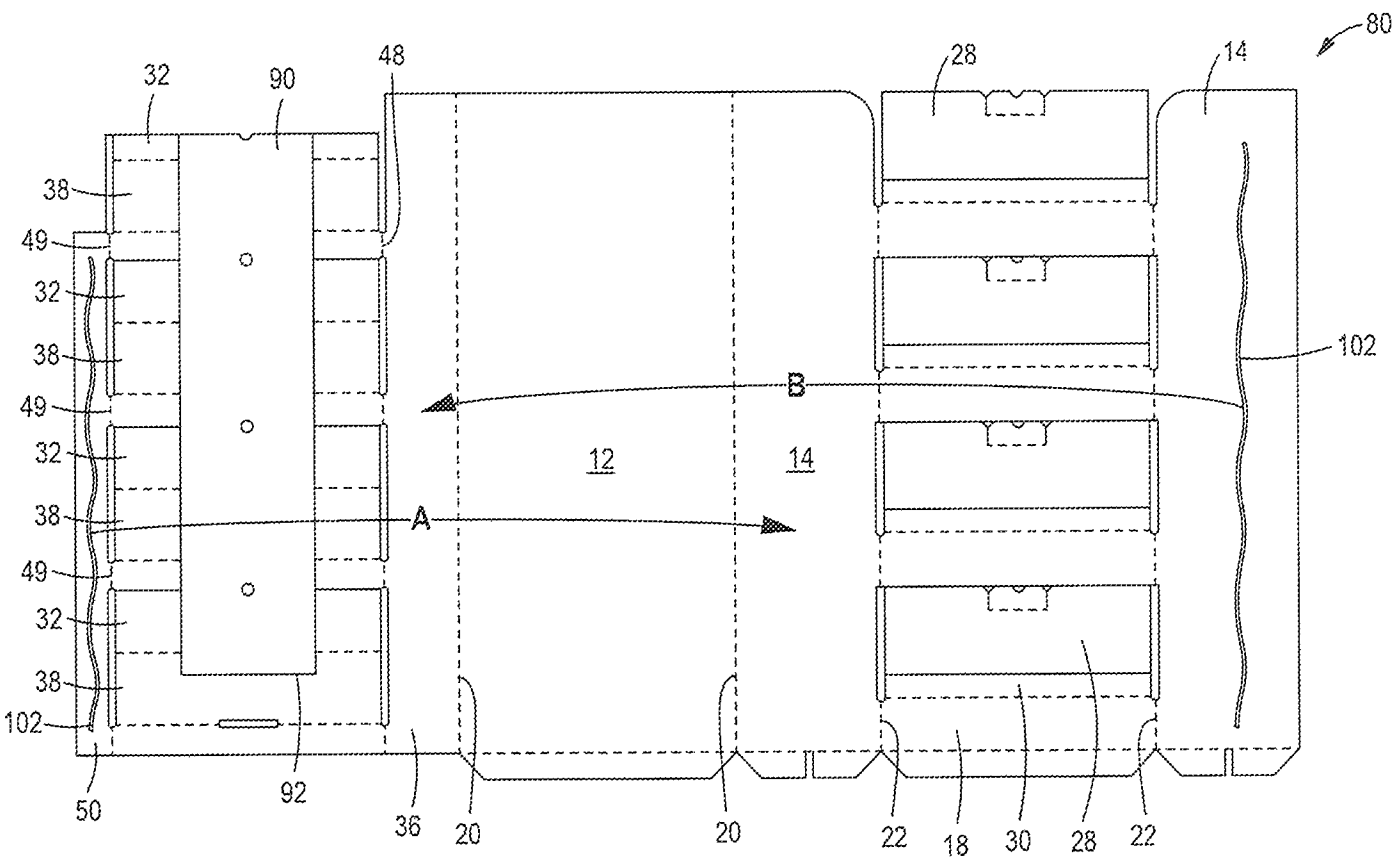
FIG. 5 is a perspective view of the structure of FIG. 4 before folding and gluing.
Figure 6:
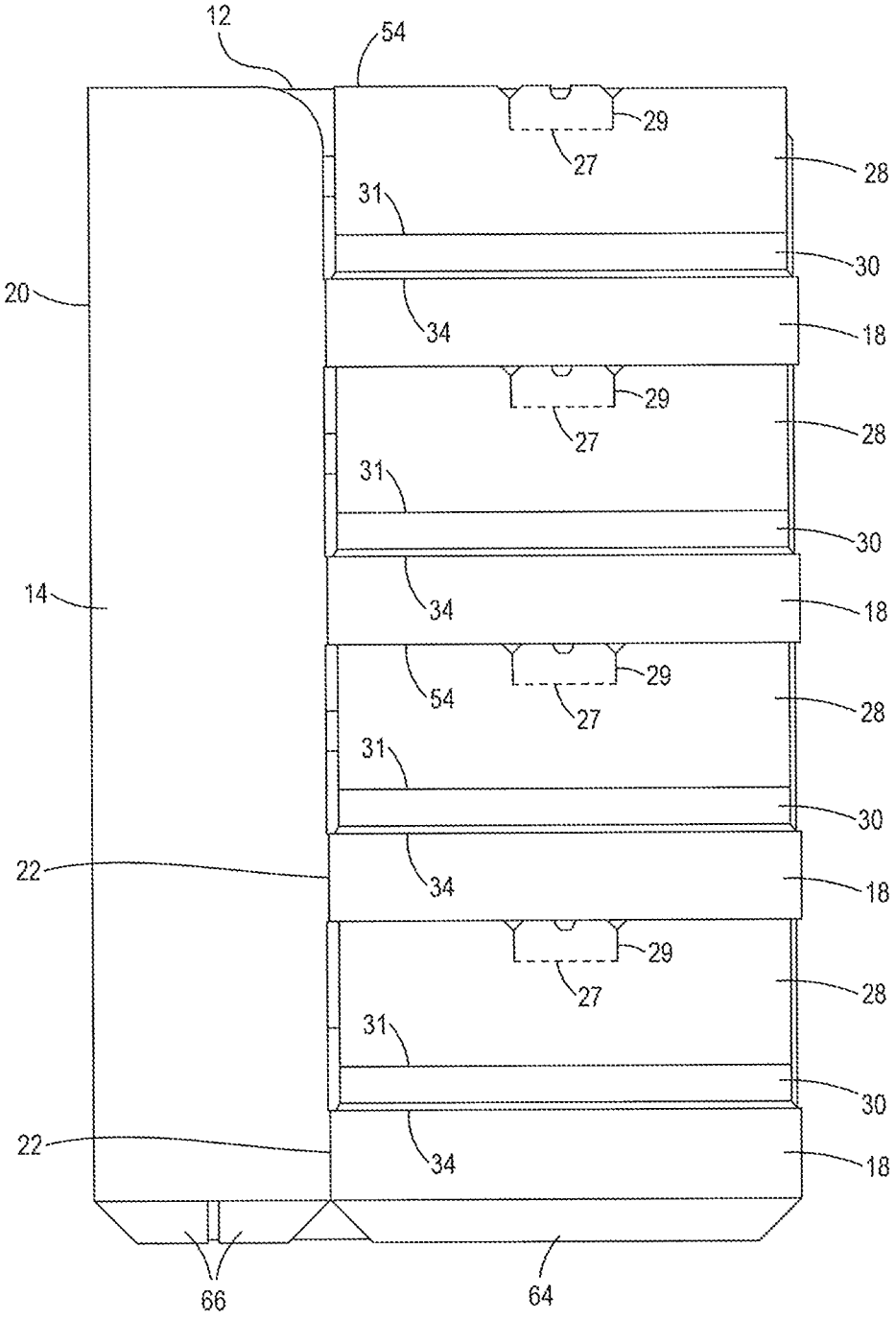
FIG. 6 is a perspective view of the structure of FIG. 5 after folding and gluing.

A method of assembling the hutch 10 will now be described with reference to FIGS. 4-6.

Step 1: Provide two blanks 40, 90 as described above.

Step 2: Adhere the second blank 90 to the rear attachment panels 32 of the first blank 40 to achieve an intermediate structure 80. Glue or other adhesive may be applied to certain of the mating surfaces of the second blank 90 and/or the rear attachment panels 32 prior to adhering them together. For example, glue 102 may be applied to each of the rear attachment panels 32 as shown in FIG. 4. During this step the second blank 90 and the first blank 40 are brought together and aligned so that the locating notch 98 and the three locating holes 99 in the second blank 90 align with the four notches 62 in the first blank 40. The resulting intermediate structure 80 is shown in FIG. 5.

Step 3: Referring to FIG. 5, apply glue 102 or other adhesive to a mating surface of either the glue panel 50 (as shown in FIG. 5) or the right side wall 14. Also, apply glue 102 or other adhesive to a mating surface of either the left side wall 14 (as shown in FIG. 5) or the half panel 36.

Step 4: Fold the intermediate structure 80 along the glue panel fold lines 49, the intermediate vertical fold lines 48 and the rear vertical fold lines 20 until the glue panel 50 mates with and adheres to the inner surface of the right side wall 14. Preferably the glue panel is folded in such a way that the glue panel 50 extends forward of the glue panel fold line 49 in the constructed (erected) hutch 10 as shown in FIG. 1. Arrow A indicates the general movement of the glue panel 50 as it is brought into mating contact with the right side wall 14.

Step 5: Fold the remaining portion of the intermediate structure 80 along both vertical fold lines 22 until the left side wall 14 mates with and is adhered to the outer-facing surface of the half panel 36. Arrow B indicates the general movement of the left side wall 14 as it is brought into mating contact with the half panel 36.

Step 6: Optionally, the assembled hutch 10 may be flattened so that it assumes the substantially flattened shape shown in FIG. 6.

Constructing the Hutch 10

A method 200 of constructing the flattened hutch 10 of FIG. 6 into a usable three-dimensional configuration will now be described with reference to FIGS. 6-12.

Figure 7:
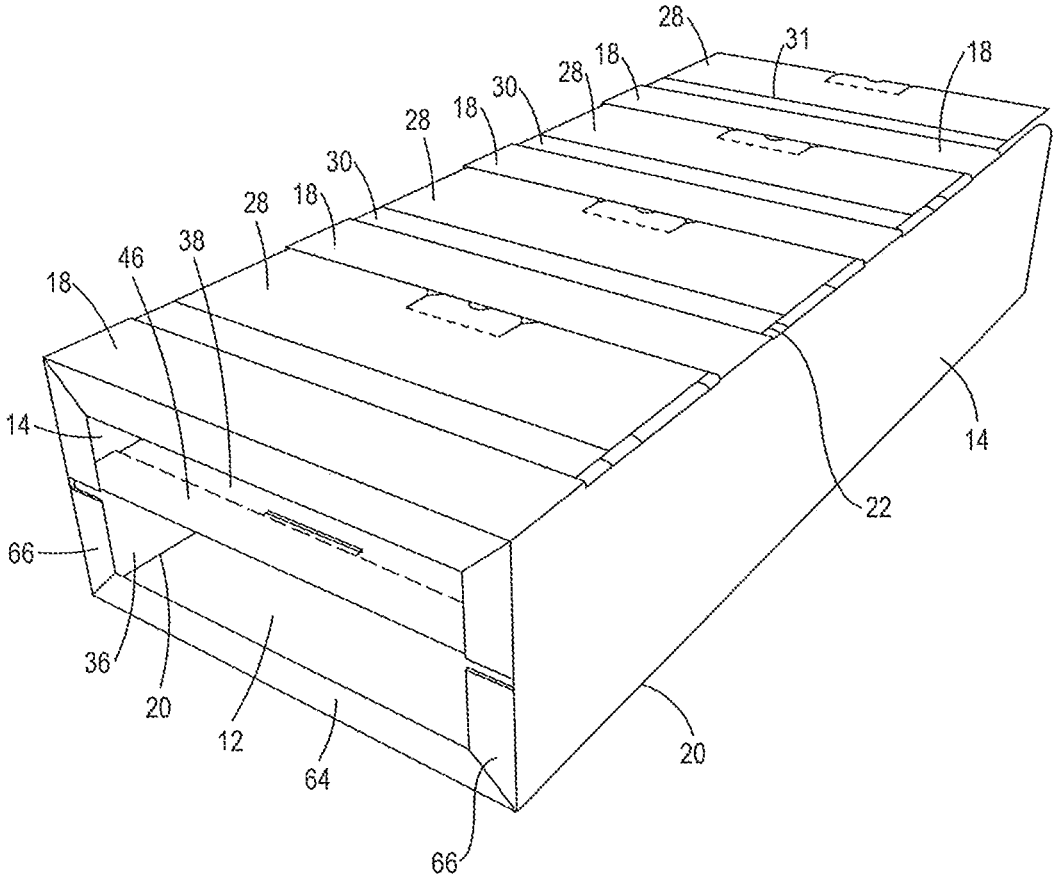
FIG. 7 is a top perspective view of the hutch of FIG. 6 after being squared up and partially assembled.

Step 202: First, the flattened hutch 10 of FIG. 6 is squared up to form the substantially rectilinear three-dimensional shape shown in FIG. 7, wherein the side walls 14 are parallel form right angles with the rear wall 12 and the front façade/front panels 18. The bottom panels 64, 66 may be folded inwardly and interlocked as shown in FIG. 7.

Step 204: Next, the hutch 10 may be stood on its base (i.e., on the bottom panels 64, 66) so that the hutch 10 is upright, as shown in FIG. 8. The rear shelf panels 38 are in a first horizontal position in which they are vertically oriented.

Also, the rear attachment panels 32, the rear shelf panels 38 and the intermediate horizontal panels 46 are substantially co-planar.

Step 206: The topmost front shelf panel 28 may be rotated outward as shown in FIG. 8 to provide easier access to the topmost rear attachment panel 32, topmost rear shelf panel 38 and/or the rear support 90. Next, as shown in FIG. 9, an operator pushes the topmost rear attachment panel 32, rear shelf panel 38 and/or the rear support 90 rearward and downward until the rear support 90 abuts (is flat against) the rear wall 12. During this step the rear shelf panels 38 rotate downward about their respective rear shelf panel fold lines 56 and the rear attachment panels 32 rotate upward about their respective rear attachment panel fold lines 58.

In this second position, shown in FIG. 10, the attachment panels 32 are bent upward in a vertical orientation, the rear shelf panels 38 are horizontally oriented and the intermediate horizontal panels 46 are vertically oriented. Although it can't be seen in FIG. 10, the bottom edge 92 of the support panel 90 contacts and rests on the floor or other surface on which the hutch is standing.

Pushing the topmost rear attachment panel 32, the topmost rear shelf panel 38 and/or the rear support 90 rearward and downward causes the other rear attachment panels 32 and rear shelf panels 38 to move in unison until every rear shelf panel 38 is moved into a horizontal orientation and every rear attachment panel 32 is bent upward. The hutch now looks like the hutch in FIG. 10.

Figure 11:
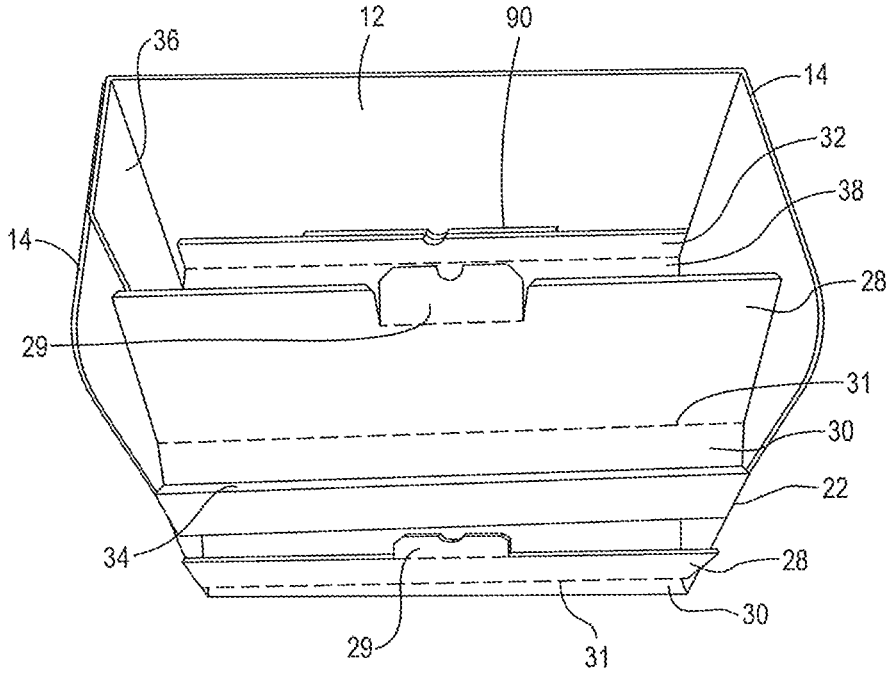
FIG. 11 is a top perspective view of the hutch of FIG. 10 with the topmost front shelf panel partially rotated into place.

Step 208: Push as by hand each inner lip panel 30 and front shelf panel 28 rearward and downward as indicated by arrow C until each inner lip panel 30 abuts a corresponding front panel 18 and each front shelf panel 28 is in a horizontal orientation. During this step each inner lip panel 30 is rotated about a lip fold line 34 and each front shelf panel 28 is rotated upward about a shelf front fold line 31. FIG. 11 is a top perspective view of the hutch of FIG. 10 with the topmost front shelf panel 28 being rotated into place.

Figure 12:
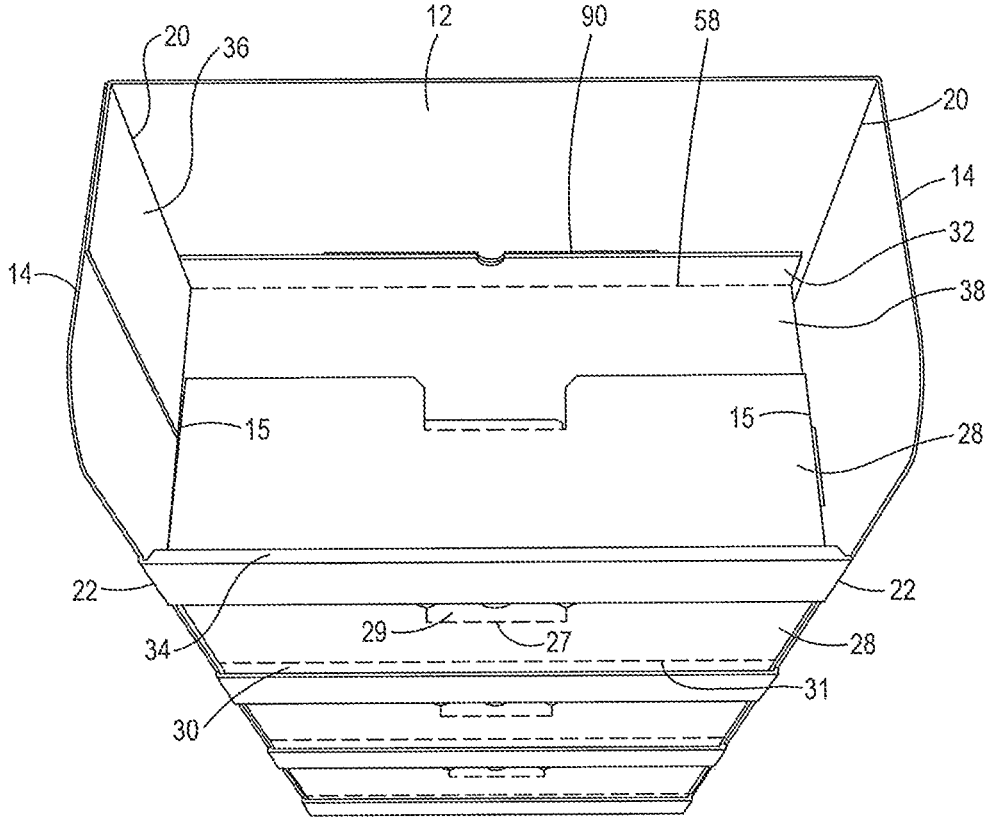
FIG. 12 is a perspective view of the hutch of FIG. 11 after the topmost front shelf panel has been rotated into place.
Figure 13:
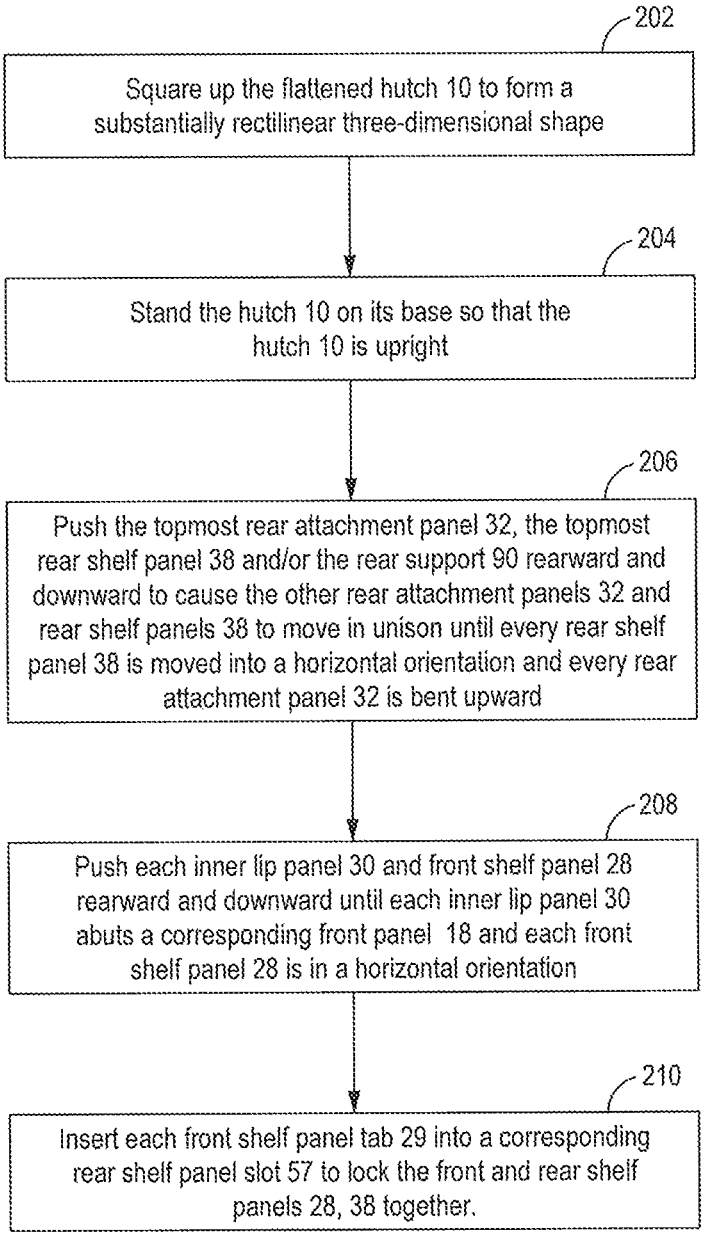
FIG. 13 is a flowchart of a method of constructing the hutch of FIG. 1.

Step 210: Insert each front shelf panel tab 29 into a corresponding rear shelf panel slot 57 to lock the front and rear shelf panels 28, 38 together. FIG. 12 shows the tab 29 of the topmost front shelf panel 28 inserted into the slot 57 in the topmost rear shelf panel 38.

After each inner lip panel 30 and front shelf panel 28 has been pushed rearward and downward and all of the tabs 29 have been inserted into a corresponding slot 57, the hutch 10 assumes the fully constructed configuration shown in FIG. 1.

It should be understood that the embodiments described above are only particular examples which serve to illustrate the principles of the invention. Modifications and alternative embodiments are contemplated which do not depart from the scope of the invention as defined by the foregoing teachings and appended claims. It is intended that the claims cover all such modifications and alternative embodiments that fall within their scope.

The invention claimed is:

1. A display hutch comprising:

a rear wall extending vertically from a base to a top edge and horizontally from one rear vertical edge to another rear vertical edge;

two side walls, each side wall extending forward from a rear vertical edge to a front vertical edge;

a plurality of front panels, each front panel extending laterally between the two side walls and hingedly attached to each side wall along the front vertical edges, the front panels defining a front façade;

the rear wall, the side walls and the front panels defining a hutch body having an interior;

a rear support substantially disposed within the interior; and a plurality of shelves, each shelf comprising a front shelf panel and a rear shelf panel, the front shelf panel affixed to the rear shelf panel to form a load bearing surface;

a plurality of inner lip panels, each attached to a front panel along a first fold line, each inner lip panel extending downwardly from the first fold line;

each front shelf panel hingedly attached to an inner lip panel along a shelf front fold line, each front shelf panel extending horizontally rearward from the shelf front fold line; and a rear attachment panel hingedly connected to each rear shelf panel along a rear attachment panel fold line, each rear attachment panel attached to the rear support, the rear support interposed between the rear attachment panels and the rear wall, wherein:

each front panel extends above the load bearing surface of the shelf to which it is directly connected by an inner lip panel to form a lip to help keep products on the shelf.

2. The hutch of claim 1, wherein:

the rear shelf panels are operably connected to each other so that they are moveable in unison from a first position in which the rear shelf panels are vertically oriented to a second position in which the rear shelf panels are horizontally oriented.

3. The hutch of claim 2, wherein:

in the second position the rear shelf panels are orthogonal to the rear support.

4. The hutch of claim 1, wherein:

the rear wall, the side walls, the front panels, the front shelf panels, the rear shelf panels and the rear attachment panels are formed from a first blank; and the rear support is formed from a second blank.

5. The hutch of claim 1 further comprising:

a plurality of intermediate horizontal panels, each hingedly attached to a rear shelf panel along an rear shelf panel fold line; and an half panel foldably connected to the rear wall and extending forward from the rear wall to a line between the rear wall and the front façade, the half panel attached to the intermediate horizontal panels along the a series of co-linear intermediate fold lines.

6. The hutch of claim 2 wherein:

when the shelves are in the second position the rear support is adjacent the rear wall.

7. The hutch of claim 1 further comprising:

a tab attached to each front shelf panel along a tab fold line; and each rear shelf panel defines a slot configured to receive a tab.

8. The hutch of claim 1 further comprising:

a glue panel foldably connected to the intermediate horizontal panels along intermediate vertical fold lines, the glue panel being adhered to a side wall.

9. The hutch of claim 2 wherein:

each front shelf panel is separately movable between a vertical orientation and a horizontal orientation.

10. A method of constructing a hutch comprising the steps of:

providing a display hutch comprising a rear wall having two rear vertical edges 20, a side wall foldably attached to each rear vertical edge 20 and having a front vertical edge, a plurality of front panels, each front panel hingedly attached to both side walls, a plurality of shelves, each shelf comprising a front shelf panel affixed to a rear shelf panel to form a load bearing surface, each front shelf panel hingedly attached to a front panel, each rear shelf panel hingedly attached to an intermediate horizontal panel along an rear shelf panel fold line, a rear attachment panel hingedly connected to each rear shelf panel, and a rear support attached to each rear attachment panel, a plurality of inner lip panels, each inner lip panel attached to a front panel along a first fold line, wherein each front panel extends above the load bearing surface of the shelf to which it is directly connected by an inner lip panel to form a lip to help keep products on the shelf;

rotating the rear shelf panels in unison by rotating one of the rear shelf panels around an rear shelf panel fold line until all of the rear shelf panels are in a horizontal orientation and the rear support abuts the rear wall; and individually moving each front shelf panel rearward and downward until each front shelf panel is in a horizontal orientation.

11. The method of claim 10 comprising the further step of:

inserting a tab extending from each front shelf panel into a slot defined by each rear shelf panel to lock the front and rear shelf panels together.

12. The method of claim 10 wherein:

the rotating in unison step comprises rotating a topmost rear shelf panel.

* * * * *